US005203642A

United States Patent [19]

Heller et al.

[11] Patent Number: 5,203,642

[45] Date of Patent: Apr. 20, 1993

[54] EXTENDABLE SCREED FOR AN ASPHALT PAVER

[75] Inventors: John W. Heller, Plano; Andrew W. Green, Geneva; James H. Bassett, Sycamore, all of Ill.

[73] Assignee: Barber-Greene Company, DeKalb, Ill.

[21] Appl. No.: 679,611

[22] Filed: Apr. 3, 1991

[51] Int. Cl.[5] ..... E01C 19/22

[52] U.S. Cl. ..... 404/118; 404/96

[58] Field of Search ..... 404/96, 118–120, 404/83, 86

[56] References Cited

U.S. PATENT DOCUMENTS

| | | | |
|---|---|---|---|
| 2,303,812 | 12/1942 | Barber | 404/118 X |
| 3,557,672 | 1/1971 | Schurtz et al. | 404/118 X |
| 3,907,451 | 9/1975 | Fisher et al. | 404/118 X |
| 4,272,213 | 6/1981 | McGovarin | 404/118 |
| 4,379,653 | 4/1983 | Brown | 404/118 |
| 4,492,490 | 1/1985 | Christine et al. | 404/118 X |
| 4,678,365 | 7/1987 | Ban et al. | 404/118 |
| 4,682,908 | 7/1987 | Domenighetti . | |
| 4,702,642 | 10/1987 | Musil | 404/118 |
| 4,818,140 | 4/1989 | Carlson | 404/118 |
| 4,948,292 | 8/1990 | Haven et al. | 404/118 X |

FOREIGN PATENT DOCUMENTS 488863 4/1970 France .

*Primary Examiner*—Carl D. Friedman
*Assistant Examiner*—Nancy P. Connolly
*Attorney, Agent, or Firm*—Jones, Day, Reavis & Pogue

[57] ABSTRACT

An extendable, floating screed for an asphalt paver including screed extensions which extend, retract and pivot relative to the main screed. The screed extensions are mounted to the main screed with a zero clearance pivot joint. The disclosed pivot joint permits the screed extension to extend, retract and pivot relative to the main screed which maintaining zero clearance at the pivot. The pivot joint includes respective mounting plates on the extension screed and the main screed which are adapted for substantial coextensive engagement with each other in a plane perpendicular to the longitudinal axis of the paver. A threaded fastener is received in coaxial apertures in the mounting plates for defining the pivot axis of the extension screed thereby permitting slope adjustment of the extension screed relative to the main screed. Tightening of the fastener draws the mounting plates in tight engagement with each other thereby establishing the zero clearance pivot joint. This zero clearance pivot joint thereby improves alignment between the main screed sole plate and the extension screed sole plate during paving operations, resulting in a higher quality road surface.

4 Claims, 5 Drawing Sheets

EXTENDABLE SCREED FOR AN ASPHALT PAVER

FIELD OF THE INVENTION

The present invention relates to asphalt pavers of the floating screed type equipped with an adjustable screed extender which projects beyond the lateral extremity of the main screed of the paver when in use.

BACKGROUND OF THE INVENTION

Typically, floating screed pavers comprise a self-propelled paving vehicle having a hopper at its forward end for receiving material from a dump truck pushed forwardly along the roadbed by the paver. The truck progressively dumps its load of paving material into the hopper.

A conveyor system on the paver transfers the paving material from the paver hopper rearwardly for discharge onto the roadbed in front of transversely arranged screw augers which spread the material laterally in front of the main screed. This screed is commonly operated so as to be called a "floating screed" by being connected to the paving vehicle by pivoted tow arms.

The screed functions to level and compact the paving material distributed by the augers, ideally leaving the finished road with a uniform, smooth surface. The height of the tow points on each side of the paver and the angle of attack of the screed may both be varied to control the depth and surface elevation of the paving mat, all as is well known to those skilled in the art.

For many paving activities, there is a need to widen the effective width of the screed. This has been accomplished by providing either a fixed-width screed with bolt-on fixed-width extensions or by providing the main screed with one or more, usually two, adjustable extensions. These "extendable" screeds have an advantage in efficiency on many paving projects where the paving width varies and/or there are obstacles to be paved around.

Earlier attempts to overcome the problems and inefficiencies involved with trying to pave variable width areas with a fixed width screed led to the development of "strikeoffs"—extendable attachments for mounting, on the front plate of a fixed main screed. Strikeoffs, as they are known in the industry, are characterized by having a sole plate (i.e., the bottom surface of the screed which contacts the paving material) which is substantially narrower (in the direction of travel) than the main screed sole plate as described on U.S. Pat. No. 4,818,140. The related front-mounted extender screed (as described on U.S. Pat. No. 4,379,653) is characterized by having a sole plate of approximately the same width, in the direction of travel, as the main screed sole plate.

Misalignment or deflection of the extender screed and its sole plate, caused by clearance or deflection at the extender or strikeoff mounting and the force of the asphalt or similar paving material on the front of the screed as the screed is towed forward by the paver, results in a mismatch between the sole plate of the main screed and the sole plate of the extension screed and a subsequent unevenness, non-uniformity, and poor quality of the newly paved road surface.

The front mounted strikeoff (usually limited to 3' per side extension beyond the main screed) or front mounted extender (sometimes extended to 8'–9' per side) often rely on the strikeoff or extender deflecting rearwardly into contact with the main screed as a means of limiting the misalignment between main and extender screed sole plates. This however still often leaves an unacceptable level of deflection and a poor quality road surface, especially on paving projects where the total extended screed width may reach to 26 feet or more. The front mounted extender at wide widths also exhibits the problem of difficulty feeding paving material to the outer ends of the screed extension.

Rear mounted extenders (mounted rearwardly of the main screed), offer the possibility of a more rigid mounting of the screed extensions and less deflection under load. Rear mounted extenders have other benefits such as improved feeding at wide widths as the paving material cascades more naturally outward and to the rear as the screed is towed forward by the paver. Rear mounted extenders, therefore, often make it possible to pave wider widths without adding cumbersome fixed transverse conveyor auger sections, greatly improving the efficiency of the paving operation.

European extendable screeds are typically constructed with extenders mounted rearwardly of the main screed. Rearward of the front face of the main screed there is then the space and structural strength to provide a more rigid extender mounting and extender height adjustment which does not deflect significantly while paving.

In the use of asphalt pavers, particularly in the U.S., there has also been a need not only to extend the width of the screed, but also to form a sloped shoulder or berm at the edge of the road. Thus, the extender screed units are mounted for pivoting movement, in a vertical plane transverse to the direction of travel, in addition to extending and retracting laterally. Prior art extension screed pivot joints generally involve a loose or headed pin or shoulder bolt with some axial clearance in the radial and/or axial clearance direction. Some prior art joints, such as the previously mentioned front-mounted strikeoff mount, lack the structural strength to totally support the extension unit and must rely on rearward deflection of the extension into contact with the main screed to limit misalignment of main and extension sole plates.

The invention described herein seeks to solve the current problems of providing an extension screed unit mounting joint which permits the extension screed and its mounting to be rear mounted, of simple and sturdy construction, extend, retract, and pivot yet maintain zero clearance between the main and extender screed. The result is improved alignment of main and extender screed sole plates while paving and a smoother more uniform paved road surface.

The invention also permits easy access to and adjustment of the extension screed mounting area and pivot. The pivot area may be easily tightened to maintain zero clearance between the main and extension screeds (and sole plate alignment) over the life of the paving machine.

OBJECTS OF THE INVENTION

It is a primary object of the present invention to provide a new and improved pivot joint for an extension screed.

Another object of the present invention is the provision of such a new and improved pivot joint which will provide zero clearance or a total absence of longitudinal movement between the extension screed unit and the main screed unit.

Still another object of the present invention is the provision of a new and improved pivot joint of the type under consideration which employs a threaded fastener and machined plates in mating engagement thereby to prevent any longitudinal movement between the extension screed unit and the adjacent main screed unit.

These and other objects and advantages of the invention will become apparent from the following specification and drawings.

DESCRIPTION OF THE INVENTION

The screed assembly of the present invention consists primarily of a main screed and an extendable screed. The main screed is preferably formed in two sections, one on each side of the center line of the paver. An extension screed unit is mounted to each of the main screed sections. The screed assembly embodying the present invention is generally of the type manufactured by Barber-Greene Company of DeKalb, Ill. under the EXTEND-A-MAT trademark. Since the screed assembly of the present invention is symmetrical with respect to the longitudinal centerline of the paver, the invention will be described with reference to only one of the main screed sections and the associated extension screed unit, it being understood that identical but opposite-hand components will be included on the other side of the screed assembly.

Figure 1:
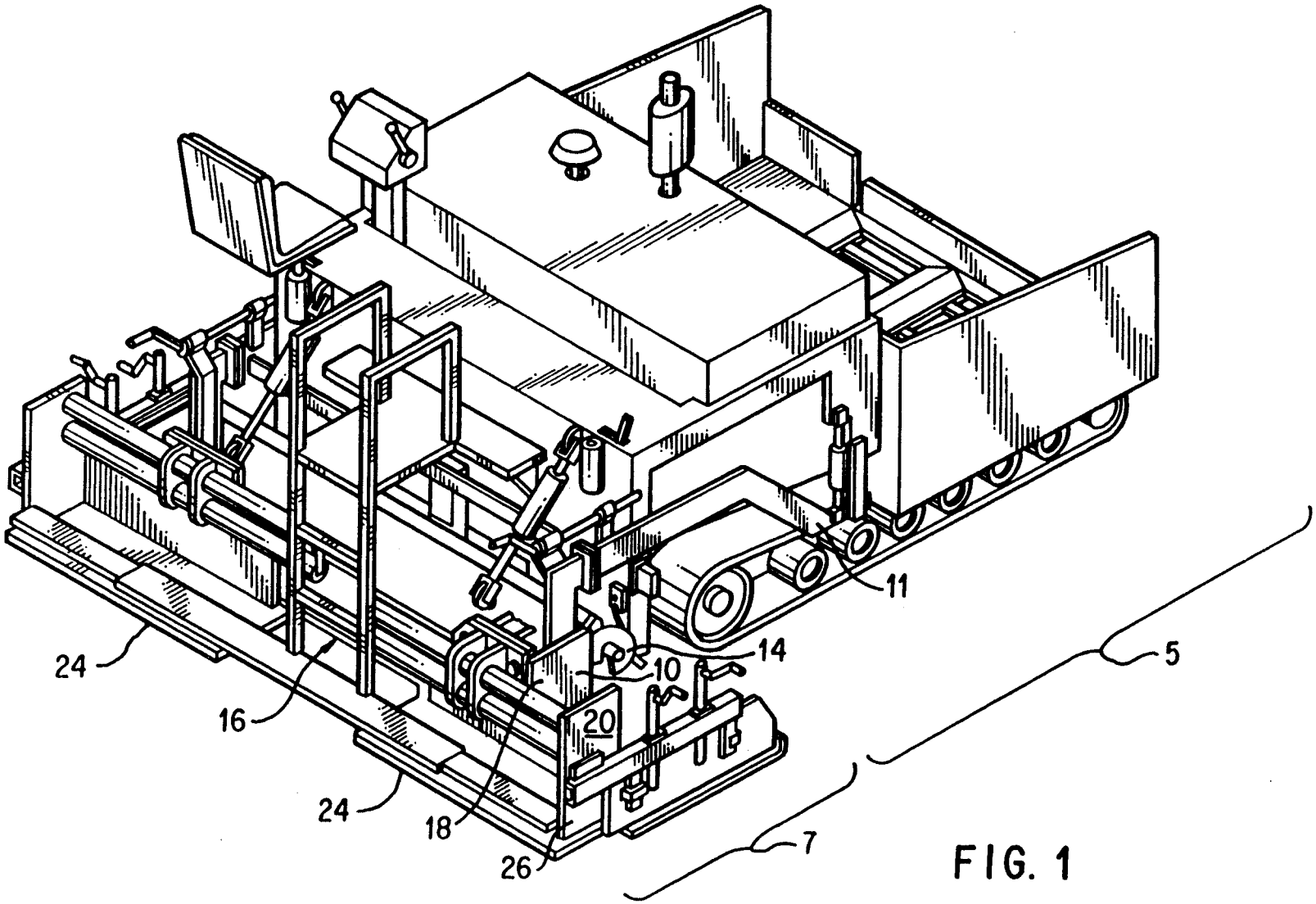
FIG. 1 is a side elevational view, somewhat diagrammatic in form, of a paving machine embodying the extendable screed assembly of the present invention.
Figure 2:
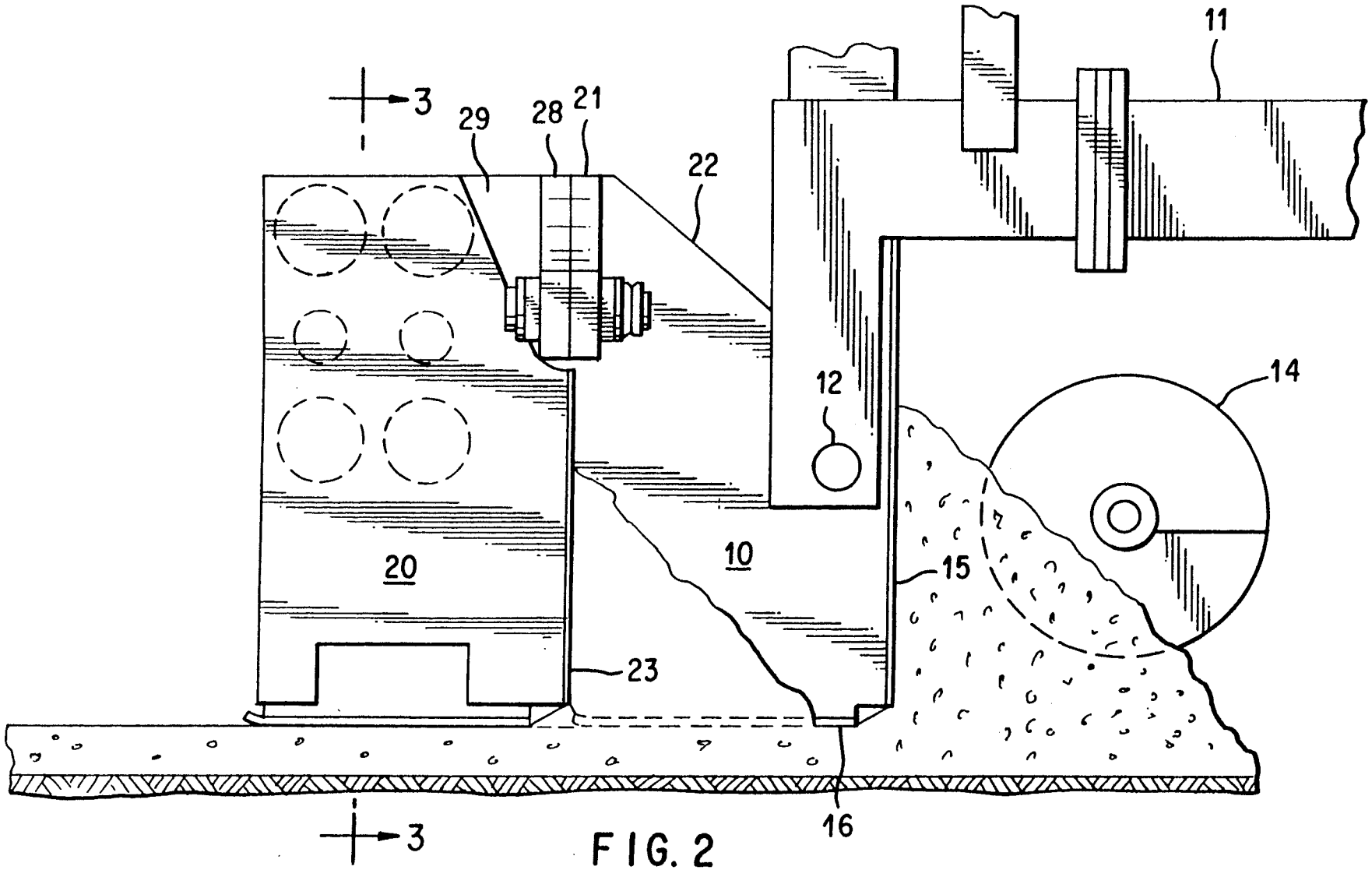
FIG. 2 is a partial side elevational view and partial vertical section of the screed assembly.
Figure 5:
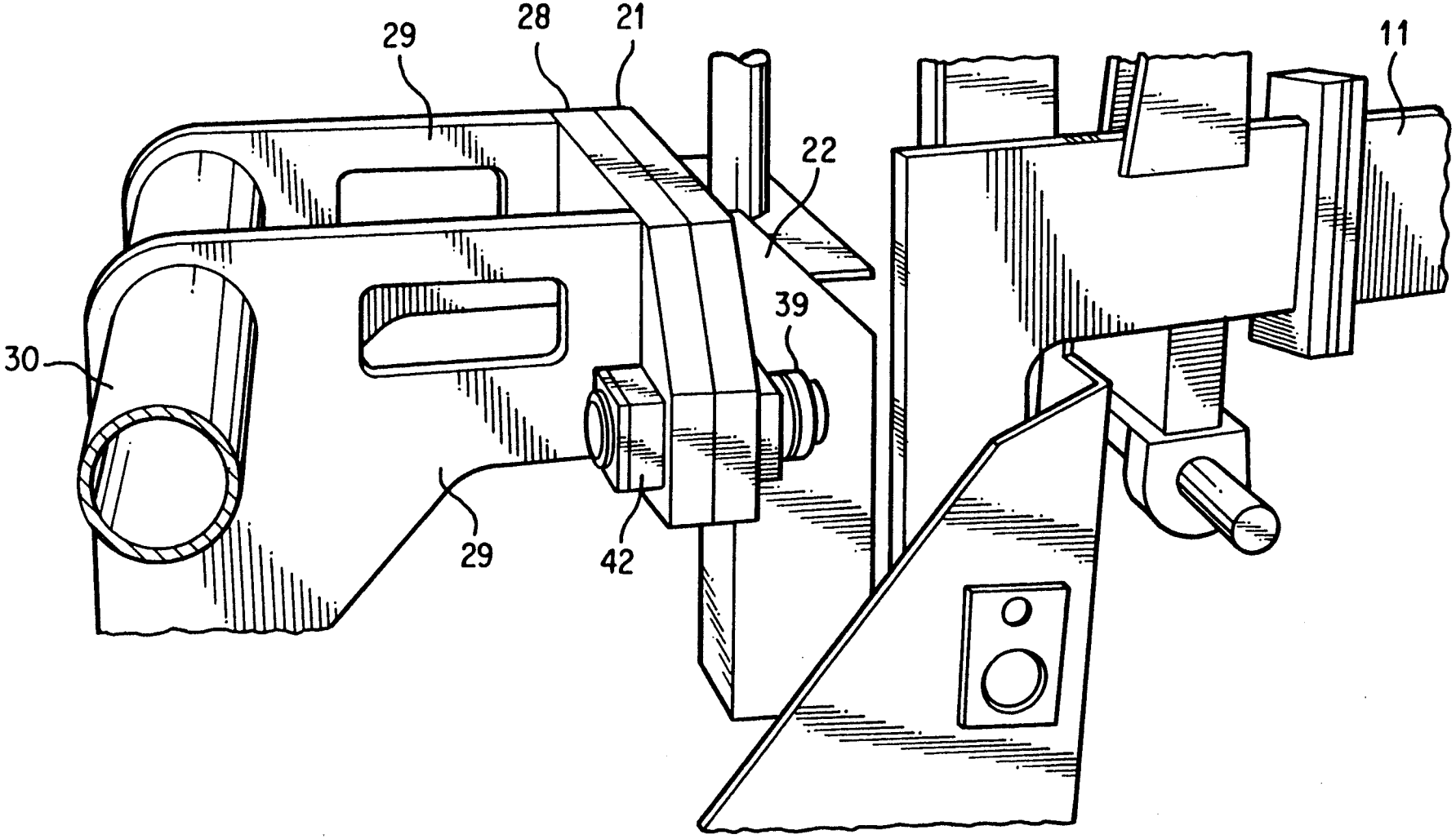
FIG. 5 is a perspective view of a portion of the screed assembly.

Referring now to the drawings, particularly FIG. 1, a paver, which may be of the rubber tire or crawler track type, is generally designated 5 and includes a floating screed assembly, generally designated 7. The right main screed section 10 is connected to one of the paver's draft arms 11 by a pivot pin 12 as shown in FIG. 2. The other end of the draft arm is pivotally connected to the chassis of the paver in a manner for towing the floating screed assembly just rearwardly of the transversely disposed screw auger 14, all as is well known to those skilled in the art. As best seen in FIGS. 1, 2 and 5, the main screed unit includes a front plate 15, a sole plate 16 and an end plate 18. The main screed unit 10 includes an integral support assembly for mounting the extension screed 20. This support assembly includes a mounting plate 21 and reinforcing plates 22.

Figure 6:
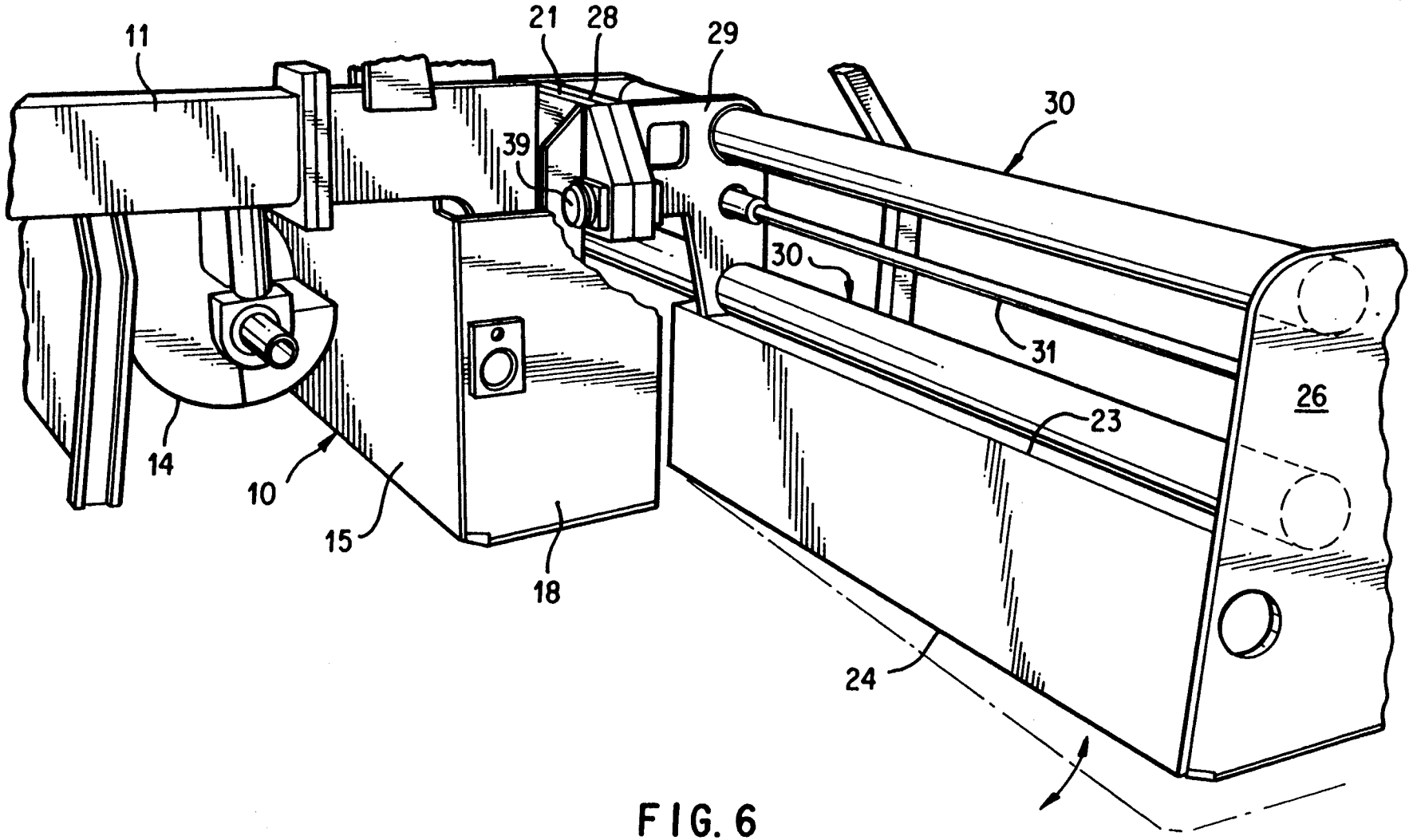
FIG. 6 is perspective view of the screed assembly with certain parts of the extension screed not being shown.

As shown in FIGS. 1 and 2, the extension screed 20 includes a front plate 23, a sole plate 24 and an end plate 26. As shown in detail in FIG. 5, the extension screed 20 also includes a mounting assembly defined primarily by a mounting plate 28 and bracket plates 29. The bracket plates 29 support a plurality of tubes 30 which are connected to the end plate 26. As shown in FIG. 6, hydraulic means 31 are provided for extending and retracting the extension screed, in particular the portion thereof defined by the front plate 23, sole plate 24 and end plate 26, relative to the main screed unit, all as is well known to those skilled in the art. Of course, both the main screed and the extension screed are provided with suitable heating and vibratory means for compacting the asphalt material, again all as is well known to those skilled in the art.

It is noted that the extension screeds are mounted rearwardly of the main screed units with the front plates of the main screed units being positioned a substantial distance forwardly of the front plates of the extension screed units. The sole plates of the main screed units extend rearwardly substantially to the front edges of the sole plates of the extension screed units.

Figure 3:
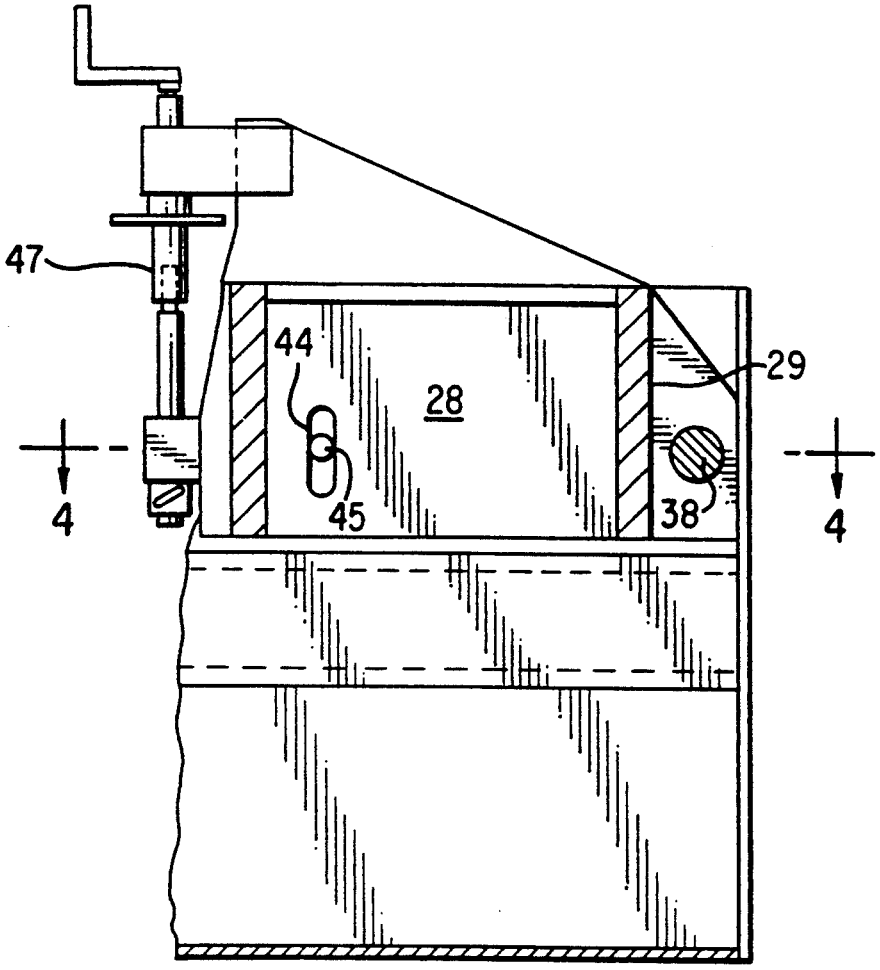
FIG. 3 is a section taken along a line 3—3 of FIG. 2.
Figure 4:
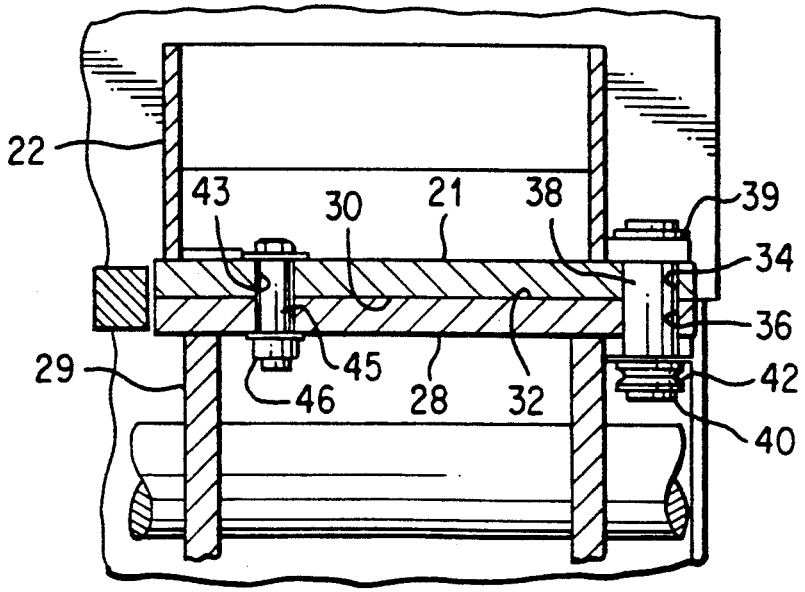
FIG. 4 is a section taken along the line 4—4 of FIG. 3.

As shown in FIGS. 3 and 4, the mounting plates 21, 28 include respective co-axial apertures 34, 36 for receiving a pivot fastener in the form of bolt-like, headed, machined and threaded 38 having a head 39. The bolt 38 includes a threaded end 40 for receiving one or more nuts 42. Mounting plates 21, 28 include respective planar surfaces 30, 32, which are preferably machined surfaces, and which are adapted to be placed into substantive co-extensive engagement with each other. A coating of molybdenum disulfide or similar lubricant on surfaces 30 and 32 allows extension screed 20 to be pivoted relative to the main screed 10 even at very high tightening forces on nuts 42 and 46.

It will be apparent that the bolt 38 defines a pivot axis for the extension screed 20, such axis being parallel with the longitudinal centerline of the paver.

Mounting plate 21 includes a further aperture 43 arranged for registry with an arcuate slot 44 formed in the mounting plate 28. A bolt 45 extends through the aperture 42 and the arcuate slot 44; the bolt 45 is threadably engageable with one or more nuts 46.

It will be apparent that tightening of the nuts 42 and 46 will serve to secure the mounting plates 21, 28 into tight engagement with each other thereby bringing about what may be termed a "zero clearance" relationship between the extension screed and the associated main screed section. Further, nuts 42, 46 can be tightened to a preload level such that surfaces 30, 32 remain in contact with each other, overcoming the forces on extension screed 20 during the paving operation and maintaining alignment of sole plates 16 and 24. It will be noted that the threaded fasteners are readily accessible for tightening and adjustment by reason of their elevated positions from the sole plates of the screed sections. Apparatus 47 is a means for overcoming friction and effecting the pivoting of extension screed 20 with respect to main screed 10. Apparatus 47 may be a screw actuator, hydraulic cylinder, etc.

It is noted while threaded "bolts" 38, 45 are shown in the described preferred embodiment, there are other methods of tightening the pivot such as wedges, springs, hydraulic clamps, etc. known to those skilled in the art which could be used at the pivot to bring the pivot joint to zero clearance. The preferred embodiment described here is merely one of the simpler and lower-cost means of obtaining zero clearance at the pivot joint.

We claim:

1. A screed assembly for a floating screed asphalt paving machine comprising:

(a) a main screed unit, including a front plate and a sole plate;

(b) a screed extension unit for at least one end of said main screed unit, said extension unit including a front plate and a sole plate;

(c) first means mounting said screed extension unit to the main screed unit for permitting said extension unit to be adjusted inwardly and outwardly of the main screed unit substantially transverse to the direction of movement of the paving machine;

(d) second means mounting each extension unit to the main screed unit for permitting said extension unit to be pivotably adjusted relative to main screed about a horizontal axis substantially longitudinal in the direction of movement of the paving machine;

(e) said first and second mounting means mounting said screed extension unit rearwardly of said main screed unit;

(f) said second mounting means including, for each extension unit and the adjacent main screed, pivot means pivoting about said horizontal, longitudinal axis, said pivot means including fastening means capable of being tightened, said pivot means in its tightened condition creating a state of zero clearance between the main screed and the extension unit in a longitudinal direction at least in the area of said second mounting means; and (g) means for effecting the pivoting of the extension unit with respect to the main screed about said horizontal, longitudinal axis by overcoming friction at the zero clearance joint.

2. The screed assembly according to claim 1 wherein said second mounting means is further defined by:

(a) first and second plates forming part of said extension unit and said main screed unit, respectively, said plates having planer surfaces in substantial co-extensive engagement with each other and lying in a plane perpendicular to said axis; and (b) said fastening means in its tightened condition serving to hold said planer surfaces in tight engagement with each other.

3. The screed assembly according to claim 2 wherein said second mounting means is further defined by:

(a) said first and second plates being provided with respective co-axial apertures; and (b) said fastening means including a threaded fastener received in said apertures.

4. The screed assembly according to claim 1 wherein said pivot means is located a substantial distance above the sole plates of the screed units thereby permitting ready access to the pivot means for adjustment of the latter.

* * * * *